US012025370B2

(12) United States Patent
Roberts et al.

(10) Patent No.: US 12,025,370 B2
(45) Date of Patent: Jul. 2, 2024

(54) REVERSE BRAYTON LNG PRODUCTION PROCESS

(71) Applicant: Air Products and Chemicals, Inc., Allentown, PA (US)

(72) Inventors: Mark Julian Roberts, Whitehall, PA (US); Katherine Bannister Wells, Macungie, PA (US); Christopher Michael Ott, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 17/965,850

(22) Filed: Oct. 14, 2022

(65) Prior Publication Data

US 2024/0125543 A1 Apr. 18, 2024

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0272* (2013.01); *F25J 1/0294* (2013.01); *F25J 2270/08* (2013.01)

(58) Field of Classification Search
CPC ..... F25J 1/0272; F25J 1/0271; F25J 1/0211; F25J 1/021; F25J 1/0204; F25J 1/0264; F25J 1/0022; F25J 1/0265; F25J 1/004; F25J 1/0267; F25J 2270/08
See application file for complete search history.

(56) References Cited

U.S. PATENT DOCUMENTS

| | | | | |
|---|---|---|---|---|
| 8,464,551 | B2 | 6/2013 | Roberts et al. | |
| 9,863,697 | B2 | 1/2018 | Roberts et al. | |
| 10,982,898 | B2 | 4/2021 | Chen et al. | |
| 2009/0095018 | A1* | 4/2009 | Bakker | F25J 1/0022 62/613 |
| 2010/0126214 | A1* | 5/2010 | Paradowski | F25J 1/0278 62/612 |
| 2014/0083132 | A1 | 3/2014 | Maunder et al. | |
| 2019/0331414 | A1* | 10/2019 | Krishnamurthy | F25J 1/0223 |
| 2020/0064060 | A1* | 2/2020 | Pierre, Jr. | F25J 1/0268 |

OTHER PUBLICATIONS

Mark J. Roberts, et al., "An Evolutionary Approach", Hydrocarbon Engineering, Feb. 2019, 1-4.

* cited by examiner

*Primary Examiner* — Brian M King
(74) *Attorney, Agent, or Firm* — Amy Carr-Trexler

(57) ABSTRACT

Described herein are methods and systems for producing a liquefied natural gas (LNG) product by cooling and liquefying a natural gas stream via indirect heat exchange with a gaseous refrigerant and then flashing and separating the liquefied natural gas stream to obtain the LNG product. In particular, the gaseous refrigerant may be a refrigerant circulating in a reverse Brayton cycle. The gaseous refrigerant is warmed in the shell side first, second and third coil-wound heat exchanger sections each having a tube side and a shell side, the shell side of the first coil-wound heat exchanger section being separated from and operating at a different pressure to the shell side of the second and third coil-wound heat exchanger sections.

16 Claims, 2 Drawing Sheets

REVERSE BRAYTON LNG PRODUCTION PROCESS

BACKGROUND

The present invention relates to a method and system for producing a liquefied natural gas (LNG) product by cooling and liquefying a natural gas stream via indirect heat exchange with a gaseous refrigerant and then flashing and separating the liquefied natural gas stream to obtain the LNG product. In particular, the gaseous refrigerant may be a refrigerant circulating in a gas expander refrigeration cycle (also known as a reverse Brayton cycle).

A variety of methods and systems for liquefying natural gas are known in the art, a number of which are described in the article "An Evolutionary Approach", Hydrocarbon Engineering, February 2019, by Roberts, Bukowski and Mitchell. FIG. 5 of the article shows a method and system employing a closed-loop reverse Brayton cycle that uses methane as a gaseous refrigerant. In this method and system, a main natural gas stream is cooled and liquefied in a coil-wound heat exchanger via indirect heat exchange with gaseous methane refrigerant flowing through the shell-side of a main coil-wound heat exchanger. The main coil-wound heat exchanger has a first tube bundle (constituting a first coil-wound heat exchanger section) in which the main natural gas stream is precooled, and a second tube bundle (constituting a second coil-wound heat exchanger section) in which the main natural gas stream is liquefied. The first and second tube bundles are contained within the same shell, such that the gaseous refrigerant flowing through the shell side of the second coil-wound heat exchanger section and the gaseous refrigerant flowing through the shell side of the first coil-wound heat exchanger section will necessarily be at the same pressure. The liquefied main natural gas stream is then flashed and separated to produce the final LNG product, and cold is recovered from the resulting flash gas streams by cooling and liquefying additional natural gas streams via indirect heat exchange with the flash gas streams in separate flash gas coil-wound heat exchanger units.

FIG. 10 of U.S. Pat. No. 10,982,898 illustrates a similar method and system to that of FIG. 5 of the article by Roberts, Bukowski and Mitchell. In the method and system of FIG. 10 of U.S. Pat. No. 10,982,898, side streams of precooled natural gas are withdrawn from an intermediate location of the flash gas coil-wound heat exchanger units and are introduced into the precooled main natural gas stream at an intermediate location of the main coil-wound heat exchanger unit, in order to improve the cooling curves of the flash gas heat exchangers.

U.S. Pat. No. 9,863,697 (and in particular FIGS. 1, 3, 4, 5, 7 and 8 thereof) similarly describes and depicts various methods and systems for liquefying natural gas employing a closed-loop reverse Brayton cycle. In the depicted methods and systems, the natural gas stream is precooled in a first coil-wound heat exchanger unit (constituting a first coil-wound heat exchanger section), liquefied in a second coil-wound heat exchanger unit (constituting a second coil-wound heat exchanger section) and then flashed and separated to produce the final LNG product. The shell sides of the first and second coil-wound heat exchanger units are in fluid flow communication such that the gaseous refrigerant, after flowing through and being warmed in the shell side of the second coil-wound heat exchanger unit, then flows though and is further warmed in the shell side of the first coil-wound heat exchanger unit, the shell sides of the first and second coil-wound heat exchanger units therefore operating at the same pressure.

U.S. Pat. No. 8,464,551 describes a method and system for liquefying natural gas using a closed-loop reverse Brayton cycle that uses nitrogen as the gaseous refrigerant and that uses first and second expanders producing gaseous refrigerant streams that are at different pressures and temperatures. The natural gas steam is cooled and liquefied in a first coil-wound heat exchanger and then subcooled in a second coil-wound heat exchanger. A gaseous stream of refrigerant from the first expander passes through and is warmed in the shell side of the first coil-wound heat exchanger. A gaseous stream of refrigerant from the second expander (that is at a colder temperature and lower pressure that the stream from the first expander) passes through and is warmed in the shell side of the first coil-wound heat exchanger.

US patent publication 2014/0083132 discloses a method and system for liquefying natural gas using an open loop natural gas expander cycle using first and second expanders that produce gaseous refrigerant streams at different pressures and temperatures. A natural gas stream is precooled in a first heat exchanger and then divided, with part of the stream forming a refrigerant stream that is sent to the second (colder) expander, and the remainder being cooled and liquefied in a second heat exchanger and then flashed and separated to provide the LNG product and a flash gas stream. Refrigeration for the second heat exchanger is provided by warming in the second heat exchanger the gaseous refrigerant stream from the second expander and the flash gas stream, and refrigeration for the first heat exchanger is provided by warming in the first heat exchanger the gaseous refrigerant stream from the first expander and further warming the gaseous refrigerant stream from the second expander and 5 the flash gas stream. As refrigeration is provided in the first and second heat exchangers by multiple different streams that are required to be kept separate, it is necessary that the first and second heat exchangers are heat exchangers of a type that can accommodate and keep separate multiple different cold streams, such as for example plate and fin heat exchangers.

BRIEF SUMMARY

Disclosed herein are methods and systems for producing a liquefied natural gas (LNG) product by cooling and liquefying a natural gas stream via indirect heat exchange with a gaseous refrigerant and then flashing and separating the liquefied natural gas stream to obtain the LNG product. The gaseous refrigerant is preferably a refrigerant circulating in a gas expander refrigeration cycle (also known as a reverse Brayton cycle). The methods and systems use parallel first and second coil-wound heat exchanger (CWHE) sections for precooling purposes and a third CWHE section for liquefaction purposes, with the shell side of the first CWHE section being separated from and operating at a different pressure from the shell side of the second and third CWHE sections, thereby allowing a closer match in the cooling curves in the third (i.e. liquefaction) CWHE section and improving the overall specific power of the process while still gaining the benefits of using heat exchangers of the coil-wound type (namely robustness of design and high processing capacity).

Several preferred aspects of the methods and systems according to the present invention are outlined below.

Aspect 1: A method of liquefying natural gas via indirect heat exchange with a refrigerant, the method using first, second and third coil-wound heat exchanger sections each having a tube side and a shell side, the shell side of the first coil-wound heat exchanger section being separated from and at a different pressure from the shell side of the second and third coil-wound heat exchanger sections, the method comprising the steps of:

(a) passing a first natural gas stream through and cooling the first natural gas stream in the tube side of the first or second coil-wound heat exchanger section to form a first precooled natural gas stream;

(b) passing the first precooled natural gas stream through and further cooling and liquefying the first precooled natural gas stream in the tube side of the third coil-wound heat exchanger section to form a first liquefied natural gas stream;

(c) flashing and separating the first liquefied natural gas stream to form a liquefied natural gas (LNG) product and one or more flash gas streams;

(d) expanding a first gaseous stream of the refrigerant to form a first expanded gaseous refrigerant stream at a first pressure and a first temperature;

(e) passing the first expanded gaseous refrigerant stream through and warming the first expanded gaseous refrigerant stream in the shell side of the first coil-wound heat exchanger section to form a first warmed gaseous refrigerant stream;

(f) passing a second gaseous stream of the refrigerant through and cooling the second gaseous stream of the refrigerant in the tube side of the first coil-wound heat exchanger section to form a precooled second gaseous refrigerant stream;

(g) passing a third gaseous stream of the refrigerant through and cooling the third gaseous stream of the refrigerant in the tube side of the second coil-wound heat exchanger section to form a precooled third gaseous refrigerant stream;

(h) combining and expanding the precooled second and third gaseous refrigerant streams to form a second expanded gaseous refrigerant stream at a second pressure and a second temperature, wherein the second pressure is lower than the first pressure and the second temperature is lower than the first temperature; and (i) passing the second expanded gaseous refrigerant stream through and warming the second expanded gaseous refrigerant stream in the shell-side of the third coil-wound heat exchanger section and then the shell-side of the second heat exchanger section to form a second warmed gaseous refrigerant stream.

Aspect 2: A method according to Aspect 1, wherein the method further comprises:

(j) compressing and combining the first warmed gaseous refrigerant stream and the second warmed gaseous refrigerant stream to form a compressed gaseous refrigerant stream; and (k) dividing the compressed gaseous refrigerant stream to form the first gaseous stream of the refrigerant, second gaseous stream of the refrigerant, and third gaseous stream of the refrigerant.

Aspect 3: A method according to Aspect 1 or 2, wherein step (c) comprises combining, flashing and separating the first liquefied natural gas stream and a second liquefied natural gas stream to form the LNG product and a first flash gas stream; and wherein the method further comprises;

(l) dividing a natural gas feed stream to form the first natural gas stream and a second natural gas stream;

(m) warming the first flash gas stream in a fourth heat exchanger section; and (n) passing the second natural gas stream through and cooling and liquefying the second natural gas stream in the fourth heat exchanger section, via indirect heat exchange with the first flash gas stream, to form the second liquefied natural gas stream.

Aspect 4: A method according to Aspect 3, wherein the method further comprises:

(o) withdrawing a precooled portion of the second natural gas stream as a first natural gas side stream from an intermediate location of the fourth heat exchanger section; and (p) introducing the first natural gas side stream into the first precooled natural gas stream before carrying out step (b).

Aspect 5: A method according to Aspect 4, wherein the first natural gas side stream constitutes less than 50% of the molar flow rate of the second natural gas stream entering the fourth heat exchanger section.

Aspect 6: A method according to any one of Aspects 3 to 5, wherein step (c) comprises combining, flashing and separating the first liquefied natural gas stream and the second liquefied natural gas stream to form a fourth liquefied natural gas stream and the first flash gas stream, and then combining, flashing and separating the fourth liquefied natural gas stream and a third liquefied natural gas stream to form the LNG product and a second flash gas stream;

wherein step (l) comprises dividing the natural gas feed stream to form the first natural gas stream, the second natural gas stream and a third natural gas stream; and wherein the method further comprises;

(q) warming the second flash gas stream in a fifth heat exchanger section; and (r) passing the third natural gas stream through and cooling and liquefying the third natural gas stream in the fifth heat exchanger section to form the third liquefied natural gas stream.

Aspect 7: A method according to Aspect 6, wherein the method further comprises:

(s) withdrawing a precooled portion of the third natural gas stream as a second natural gas side stream from an intermediate location of the fifth heat exchanger section;

(t) introducing the second natural gas side stream into the first precooled natural gas stream before carrying out step (b).

Aspect 8: A method according to Aspect 7, wherein the second natural gas side stream constitutes less than 50% of the molar flow rate of the third natural gas stream entering the fifth heat exchanger section.

Aspect 9: A method according to any one of Aspects 3 to 8, wherein the first natural gas stream constitutes more than 50% of the molar flow rate of the natural gas feed stream.

Aspect 10: A method according to any one of Aspects 1 to 9, wherein the refrigerant is a refrigerant comprising more than 50 mole % methane.

Aspect 11: A method according to any one of Aspects 1 to 10, wherein the refrigerant circulates in a closed-loop circuit.

Aspect 12: A method according to any one of Aspects 1 to 11, wherein the first natural gas stream is at a pressure of at least 60 bara, more preferably at least 80 bara.

Aspect 13: A method according to any one of Aspects 1 to 12, wherein the first precooled natural gas stream is at a temperature of between 10° C. and −50° C., more preferably between 0° C. and −30° C.

Aspect 14: A method according to any one of Aspects 1 to 13, wherein the first liquefied natural gas stream is withdrawn from the third coil-wound heat exchanger section at a temperature of between −90° C. and −120° C.

Aspect 15: A system for liquefying natural gas via indirect heat exchange with a refrigerant, wherein the system comprises:

a first coil-wound heat exchanger section having a tube side and a shell side;

a second coil-wound heat exchanger section having a tube side and a shell side;

a third coil-wound heat exchanger section having a tube side and a shell side;

a conduit configured and arranged to introduce a first natural gas stream into the tube side of the first or second coil-wound heat exchanger section, said tube side of the first or second coil-wound heat exchanger section being configured to cool the first natural gas stream to form a first precooled natural gas stream;

a conduit configured and arranged to withdraw the first precooled natural gas stream from said tube side of the first or second coil-wound heat exchanger section and introduce the first precooled natural gas stream into the tube side of the third coil-wound heat exchanger section, the tube side of the third coil-wound heat exchanger section being configured to further cool and liquefy the first precooled natural gas stream to form a first liquefied natural gas stream;

one or more expansion and separation devices configured and arranged to receive, flash and separate the first liquefied natural gas stream to form a liquefied natural gas (LNG) product and one or more flash gas streams;

an expansion device configured and arranged to receive and expand a first gaseous stream of the refrigerant to form a first expanded gaseous refrigerant stream;

a conduit configured and arranged to introduce the first expanded gaseous refrigerant stream into the shell side of the first coil-wound heat exchanger section, the shell side of the first coil-wound heat exchanger section being configured to warm the first expanded gaseous refrigerant stream to form a first warmed gaseous refrigerant stream;

a conduit configured and arranged to introduce a second gaseous stream of the refrigerant into the tube side of the first coil-wound heat exchanger section, the tube side of the first coil-wound heat exchanger section being configured to cool the second gaseous stream of the refrigerant to form a precooled second gaseous refrigerant stream;

a conduit configured and arranged to introduce a third gaseous stream of the refrigerant into the tube side of the second coil-wound heat exchanger section, the tube side of the second coil-wound heat exchanger section being configured to cool the third gaseous stream of the refrigerant to form a precooled third gaseous refrigerant stream;

one or more conduits and expansion devices configured and arranged to receive, combine and expand the precooled second and third gaseous refrigerant streams to form a second expanded gaseous refrigerant stream; and a conduit configured and arranged to introduce the second expanded gaseous refrigerant stream into the shell-side of the third coil-wound heat exchanger section, the shell-side of the third coil-wound heat exchanger being configured to warm the second expanded gaseous refrigerant stream and the shell-side of the second third coil-wound heat exchanger being configured to then receive and further warm the second expanded gaseous refrigerant stream to form a second warmed gaseous refrigerant stream;

wherein the shell side of the first coil-wound heat exchanger section is separated from the shell side of the second and third coil-wound heat exchanger sections such that the shell side of the first coil-wound heat exchanger section can be at a different pressure from the shell side of the second and third coil-wound heat exchanger sections.

Aspect 16: A system according to Aspect 15, wherein the system further comprises:

one or more conduits and compression devices configured and arranged to compress and combine the first warmed gaseous refrigerant stream and the second warmed gaseous refrigerant stream to form a compressed gaseous refrigerant stream; and a set of conduits configured and arranged to divide the compressed gaseous refrigerant stream to form the first compressed gaseous stream of the refrigerant, second compressed gaseous stream of the refrigerant, and third compressed gaseous stream of the refrigerant.

Aspect 17: A system according to Aspects 15 or 16, wherein the one or more expansion and separation devices configured and arranged to receive, flash and separate the first liquefied natural gas stream are configured and arranged to flash and separate the first liquefied natural gas stream and a second liquefied natural gas stream to form the LNG product and a first flash gas stream; and wherein the system further comprises;

a set of conduits configured and arranged to divide a natural gas feed stream to form the first natural gas stream and a second natural gas stream; and a fourth heat exchanger section configured and arranged to receive and warm the first flash gas stream, and to receive and cool and liquefy the second natural gas stream via indirect heat exchange with the first flash gas stream to form the second liquefied natural gas stream.

Aspect 18: A system according to Aspect 17, wherein the system further comprises:

a conduit configured and arranged to withdraw a precooled portion of the second natural gas stream as a first natural gas side stream from an intermediate location of the fourth heat exchanger section and to introduce the first natural gas side stream into the first precooled natural gas stream prior to introduction of the first precooled natural gas stream into the tube side of the third coil-wound heat exchanger section.

Aspect 19: A system according to Aspect 17 or 18, wherein the one or more expansion and separation devices configured and arranged to receive, flash and separate the first liquefied natural gas stream comprise a first set of expansion and separation devices configured and arranged to receive, flash and separate the first liquefied natural gas stream and the second liquefied natural gas stream to form a fourth liquefied natural gas stream and the first flash gas stream, and a second set of expansion and separation devices configured and arranged to receive, flash and separate the fourth liquefied natural gas stream and a third liquefied natural gas stream to form the LNG product and a second flash gas stream;

wherein the set of conduits configured and arranged to divide a natural gas feed stream are configured and arranged to divide the natural gas feed stream to form the first natural gas stream, the second natural gas stream and a third natural gas stream; and wherein the system further comprises fifth heat exchanger section configured and arranged to receive and warm the second flash gas stream, and to receive cool and liquefy the third natural gas stream via indirect heat exchange with the second flash gas stream to form the third liquefied natural gas stream.

Aspect 20: A system according to Aspect 19, wherein the method further comprises a conduit configured and arranged to withdraw a precooled portion of the third natural gas stream as a second natural gas side stream from an intermediate location of the fifth heat exchanger section and to introduce the second natural gas side stream into the first precooled natural gas stream prior to introduction of the first precooled natural gas stream into the tube side of the third coil-wound heat exchanger section.

DETAILED DESCRIPTION

Figure 1:
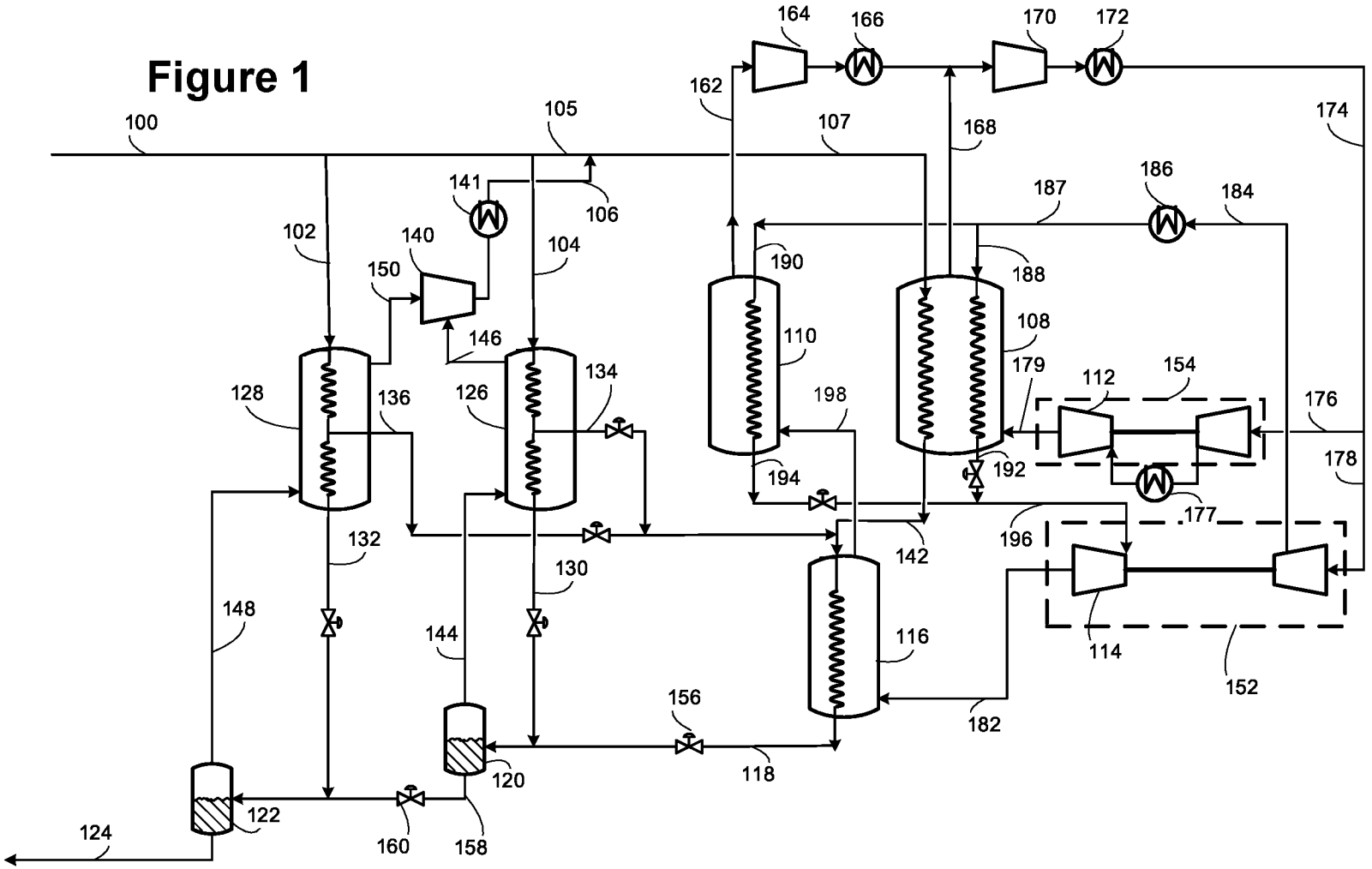
FIG. 1 is a schematic flow diagram depicting a method and system for cooling and liquefying natural gas according to a first embodiment of the present invention.

Described herein are methods and systems for producing a liquefied natural gas (LNG) product by cooling and liquefying a natural gas stream via indirect heat exchange with a gaseous refrigerant and then flashing and separating the liquefied natural gas stream to obtain the LNG product.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question and are not intended to indicate any specific order of the features, unless and only to the extent that such order is specifically recited.

As used herein, the term "natural gas" encompasses also synthetic and/or substitute natural gases. The major component of natural gas is methane (which typically comprises at least 85 mole %, more often at least 90 mole %, and on average about 95 mole % of the feed stream). Other typical components of raw natural gas that may be present in smaller amounts include one or more "light components" (i.e. components having a lower boiling point than methane) such as nitrogen, helium, and hydrogen, and/or one or more "heavy components" (i.e. components having a higher boiling point than methane) such as carbon dioxide and other acid gases, moisture, mercury, and heavier hydrocarbons such as ethane, propane, butanes, pentanes, etc. However, prior to being liquefied the raw natural gas feed stream will be treated if and as necessary in order to reduce the levels of any heavy components that may be present down to such levels as are needed to avoid freezing or other operational problems in the heat exchanger section or sections in which the natural gas is to be cooled and liquefied.

As used herein, the term "liquefied natural gas" refers to natural gas that is in the liquid phase or, in relation to natural gas that is at a temperature and pressure above its critical point (i.e. that is a supercritical fluid), to natural gas that is at a density greater than its critical point density. Likewise, references to "liquefying" a natural gas refer to the conversion (typically by cooling) of a natural gas from vapor to liquid (i.e. from the gaseous to liquid phase) or, in relation to natural gas that is at a temperature and pressure above its critical point, to the act of increasing (typically by cooling) the density of the natural gas to a density greater than its critical point density.

As used herein, the term "indirect heat exchange" refers to heat exchange between two fluids where the two fluids are kept separate from each other by some form of physical barrier.

As used herein, the term "heat exchanger section" refers to a unit or a part of a unit in which indirect heat exchange is taking place between one or more streams of fluid flowing through the cold side of the heat exchanger section and one or more streams of fluid flowing through the warm side of the heat exchanger section, the stream(s) of fluid flowing through the cold side being thereby warmed, and the stream(s) of fluid flowing the warm side being thereby cooled (the terms "warm side" and "cold side" being purely relative). Unless otherwise indicated, a heat exchanger section may a heat exchanger section of any suitable type, such as but not limited to a heat exchanger section of a shell and tube, coil wound, or plate and fin type of heat exchanger.

As used herein, the term "coil wound heat exchanger" refers to a heat exchanger of the type known in the art, comprising one or more tube bundles encased in a shell casing. A "coil wound heat exchanger section" comprises one or more of said tube bundles, the "tube side" of said bundle(s), i.e. the interior of the tubes in the bundle(s), typically representing the warm side of said section and defining one or more passages (also referred to as tube circuits) through the section, and the "shell side" of said bundle(s), i.e. the space between and defined by the interior of the shell casing and exterior of the tubes, typically representing the cold side of said section and defining a single passage through the section. The shell side is almost always used as the cold side of the section, with the refrigerant providing cooling duty to the section being therefore passed through the shell side, because the shell side provides much lower flow resistance and allows for a much greater pressure drop than the tube side which makes passing expanded streams of cold refrigerant through the shell side much more effective and efficient. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section it is not possible use more than one stream of refrigerant in the shell side of the coil wound heat exchanger section without said streams of refrigerant mixing in the shell side of said heat exchanger section.

As used herein, the term "flashing" (also referred to in the art as "flash evaporating") refers to the process of reducing the pressure of a liquid (or supercritical or two-phase) stream so as to cool the stream and vaporize some of the liquid resulting in a colder, lower pressure two-phase mixture of vapor and liquid, the vapor present in this mixture also being referred to as the "flash gas". As use herein, the phrase "flashing and separating" refers to the process of flashing a stream and separating the flash gas from the remaining liquid.

As used herein, the phrases "gaseous stream of refrigerant" and "gaseous refrigerant stream" refer to a stream of refrigerant where substantially all, and more preferably all of the stream is vapor (i.e. is in the gaseous phase) Preferably the stream is at least 90 mole % vapor, and more preferably at least 95 mole %, or at least 99 mole % vapor.

As used herein, the term "refrigeration cycle" refers a series of steps that a circulating refrigerant undergoes in order to provide refrigeration to another fluid. In a gas expander refrigeration cycle or "reverse Brayton cycle" a circulating gaseous refrigerant is expanded in one or more expansion devices (preferably one or more turbo-expanders or other forms of isentropic expansion devices) to provide a cold gaseous refrigerant that is then warmed via indirect heat exchange with the one or more streams of fluid that are to be cooled, and the resulting warmed refrigerant is then compressed and cooled against one or more ambient temperature fluids before being returned to the one or more expansion devices. In an "open-loop refrigeration cycle" a feed stream that contains the fluid that is to be cooled/liquefied is divided to provide a source of the circulating refrigerant as well as the stream that is cooled/liquefied. For example, in an "open-loop natural gas refrigeration cycle" a first part of the natural gas feed stream may be cooled and liquefied to form an LNG product, while a second part is used as a refrigerant and is then recycled back into the natural gas feed stream. Conversely, in a "closed-loop refrigerant cycle" the refrigerant circulates in a closed-loop circuit and does not mix during ordinary circulation with the fluid that is to be cooled/liquefied (although if the refrigerant has the same composition as that of the fluid that is to be cooled/liquefied, or contains the same ingredients, the fluid feed stream may initially be used to fill the closed-loop circuit and/or may be used to periodically top-up the circuit to take account of leakage or other operational losses).

As used herein, the term "expansion device" refers to any device or collection of devices suitable for expanding and thereby lowering the pressure of a fluid. Suitable types of expansion device for expanding a fluid include "isentropic" expansion devices, such turbo-expanders or hydraulic turbines, in which the fluid is expanded and the pressure and temperature of the fluid thereby lowered in a substantially isentropic manner (i.e. in a manner that generates works); and "isenthalpic" expansion devices, such as valves or other throttling devices, in which the fluid is expanded and the pressure and temperature of the fluid thereby lowered without the generating work.

As used herein, the term "separation device" refers to any device or collection of devices suitable for separating a two-phase (vapor and liquid) stream or mixture into separate vapor (gas) and liquid streams. Exemplary of separation devices include phase separators and distillation columns. The term "distillation column" refers to a column containing one or more separation stages, composed of devices such as packing or trays, that increase contact and thus enhance mass transfer between upward rising vapor and downward flowing liquid inside the column such that liquid and vapor streams exiting the column are not in equilibrium (the concentration of higher volatility components being increased in the upward rising vapor and the concentration of lower volatility components being increased in the downward flowing liquid). The term "phase separator" refers to a drum or other form of vessel in which a two-phase stream can separate into its constituent vapor and liquid phases where the liquid and vapor streams exiting the vessel are in equilibrium (there being no separation stages inside a phase separator).

Solely by way of example, various exemplary embodiments of the invention will now be described with reference to the Figures. In the Figures, where a feature is common to more than one Figure that feature has been assigned the same reference numeral. Unless a feature is specifically described as being different from other embodiments in which it is shown in the drawings, that feature can be assumed to have the same structure and function as the corresponding feature in the embodiment in which it is described. Moreover, if that feature does not have a different structure or function in a subsequently-described embodiment, it may not be specifically referred to in the specification.

Referring to FIG. 1, a method and system for cooling and liquefying natural gas in accordance with a first embodiment of the present invention is shown.

A natural gas feed stream (100), which is typically at ambient temperature and preferably at a pressure above 60 bara and more preferably above 80 bara, is divided into a first portion, constituting more than 50% and preferably more than 60% of the molar flow rate of natural gas feed stream and hence representing a major portion of natural gas feed stream, and second and third portions representing minor portions of the natural gas feed stream, the first portion forming a first natural gas stream (105), and the second and third portions forming respectively a second natural gas stream (102) and a third natural gas stream (104).

The first natural gas stream (105, 107) is fed to and passed through a tube circuit in the tube side of a first coil-wound heat exchanger section (108) where it is cooled, preferably to a temperature of between 10 and −50° C. and more preferably to a temperature of between 0 and −30° C., forming a first precooled natural gas stream (142) that is withdrawn from the first coil-wound heat exchanger section. The first precooled natural gas stream (142) is then fed to and passed through the tube side of a third coil-wound heat exchanger section (116) where it is further cooled, preferably to a temperature of between −90° C. and −120° C. and more preferably about −100° C., and liquefied forming a first liquefied natural gas stream (118) that is withdrawn from the third coil-wound heat exchanger section.

The second natural gas stream (104) is fed to a fourth heat exchanger section (126) and the third natural gas stream (102) is fed to a fifth heat exchanger section (128). Preferably, and as shown in FIG. 1, the fourth heat exchanger section (126) is a coil-wound heat exchanger section comprising a first (warm) and a second (cold) tube bundle, and the fifth heat exchanger section (128) is a coil-wound heat exchanger section comprising a first (warm) and a second (cold) tube bundle.

The second natural gas stream (104) is passed through the tube side of the warm tube bundle of the fourth heat exchanger section (126) where it is cooled, preferably to a temperature of between −15 and −25° C., forming a precooled second natural gas stream at an intermediate location of the fourth heat exchanger section between the warm and cold tube bundles. A minor portion of the precooled second natural gas stream, constituting less than 50% and more preferably between 30% and 40% of the molar flow rate of the second natural gas stream feed stream (104), is withdrawn from said intermediate location of the fourth heat exchanger section, forming a first natural gas side stream (134). The remainder of the precooled second natural gas stream is passed through the tube side of the cold tube bundle of the fourth heat exchanger section (126) where it is further cooled and liquefied forming a second liquefied natural gas stream (130) that is withdrawn from the fourth heat exchanger section.

The third natural gas stream (102) is passed through the tube side of warm tube bundle of the fifth heat exchanger section (128) where it is cooled, preferably to a temperature of between −15 and −25° C., forming a precooled third natural gas stream at an intermediate location of the fifth heat exchanger section between the warm and cold tube bundles. A minor portion of the precooled third natural gas stream, constituting less than 50% and more preferably between 30% and 40% of the molar flow rate of the third natural gas stream feed stream (102), is withdrawn from said intermediate location of the fifth heat exchanger section, forming a second natural gas side stream (136). The remainder of the precooled third natural gas stream is passed through the tube side of cold tube bundle of the fifth heat exchanger section (128) where it is further cooled and liquefied forming a third liquefied natural gas stream (132) that is withdrawn from the fifth heat exchanger section.

The first natural gas side stream (134) and the second natural gas side stream (136) and introduced into (and thereby combined with) the first precooled natural gas stream (142), prior to the first precooled natural gas stream (142) being fed into and passed through the tube side of the third coil-wound heat exchanger section (116) as described above.

The first liquefied natural gas stream (118), second liquefied natural gas stream (130) and third liquefied natural gas stream (132) are then combined, flashed and separated to form a liquefied natural gas (LNG) product stream (124) and first and second flash gas streams (144 and 148).

More specifically, and as illustrated in FIG. 1, the first liquefied natural gas stream (118) may be flashed by passing the stream through an expansion device (156), the second liquefied natural gas stream (130) may be flashed by passing the stream through a separate expansion device, and the resulting flashed streams may then be combined and introduced into a first flash drum (120) or other form of phase separator in which the streams are separated into vapor and liquid phases, the liquid from the bottom of the first flash drum (120) being withdrawn to form a fourth liquefied natural gas stream (158) and the vapor from the top of the first flash drum (120) being withdrawn to form the first flash gas stream (144). The first flash drum (120) preferably operates at a pressure of about 10 bara, with the vapor collected and withdrawn from the top of the drum as the first flash gas stream (144) preferably representing about 25 mole % of the combined flashed first and second liquefied natural gas streams, and with the liquid collected and withdrawn from the bottom of the drum as the fourth liquefied natural gas stream (158) representing the remainder of the combined flashed first and second liquefied natural gas streams. The fourth liquefied natural gas stream (158) may then be flashed by passing the stream through an expansion device (160), the third liquefied natural gas stream (132) may be flashed by passing the stream through a separate expansion device, and the resulting flashed streams may then be combined and introduced into a second flash drum (122) or other form of phase separator in which the streams are separated into vapor and liquid phases, the liquid from the bottom of the second flash drum (122) being withdrawn to form the LNG product stream (124) and the vapor from the top of the second flash drum (122) being withdrawn to form the second flash gas stream (148). The second flash drum (122) preferably operates at a pressure of about 3 bara, with the vapor collected and withdrawn from the top of the drum as the second flash gas stream (148) preferably representing about 17 mole % of the combined flashed fourth and third liquefied natural gas streams, and with the liquid collected and withdrawn from the bottom of the drum as the LNG product stream (124) representing the remainder of the combined flashed fourth and third liquefied natural gas streams. Each of the expansion devices used for flashing the first, second, fourth and third liquefied natural gas streams may be an expansion device of any suitable type, such as for example an isenthalpic valve (as shown in FIG. 1)) or a work producing hydraulic turbine.

In other embodiments, not illustrated, the first and second liquefied natural gas streams could be combined and then flashed in a single expansion device, which could be separate from or integrated with the first flash drum, or the first and second liquefied natural gas streams could be flashed separately and then sent to separate flash drums, with the vapor streams from the separate drums being combined and the liquid streams from the separate drums being combined. Likewise, the fourth and third liquefied natural gas streams could be combined and then flashed in a single expansion device, which could be separate from or integrated with the second flash drum, or the fourth and third liquefied natural gas streams could be flashed separately and then sent to separate flash drums, with the vapor streams from the separate drums being combined and the liquid streams from the separate drums being combined.

The LNG product stream (124) may be sent to a storage tank (not shown) and/or or transported directly of site (for example via a pipeline or LNG tankers). Any additional flash gas or boil-off gas generated in the storage tank may be compressed and recycled to the natural gas feed stream (100) or first natural gas stream (105) (not shown).

The first flash gas stream (144) is fed to and passed through the shell side of the fourth heat exchanger section (126) in which the first flash gas stream is warmed, via indirect heat exchange with the second natural gas feed stream (104) passing through the tube side of the warm and cold bundles of the fourth heat exchanger section, forming a warmed first flash gas stream (146) exiting the fourth heat exchanger section at a temperature that is typically near ambient temperature. The second flash gas stream (148) is fed to and passed through the shell side of the fifth heat exchanger section (128) in which the second flash gas stream is warmed, via indirect heat exchange with the third natural gas feed stream (102) passing through the tube side of the warm and cold bundles of the fifth heat exchanger section, forming a warmed second flash gas stream (150) exiting the fifth heat exchanger section at a temperature that is typically near ambient temperature.

Although in the embodiment illustrated in FIG. 1 the first flash drum (120) and second flash drum (122) are shown as being separate stand-alone devices, in a variant embodiment to that shown, that is in particular advantageous for floating LNG (FLNG) applications, the first flash drum (120) may be integrated into the shell of the fourth heat exchanger section (126) and likewise the second flash drum (122) may be integrated into the shell of the fifth heat exchanger section (128), thereby reducing piping and space requirements. This integration of a flash drum and coil-wound heat exchange may be accomplished in the manner described in U.S. Pat. No. 10,982,898, the contents of which are hereby incorporated by reference. U.S. Pat. No. 10,982,898 also a describes the integration of a nitrogen stripping section which is also a possible option for the current invention.

The warmed second flash gas stream (150) and warmed first flash gas stream (146) may then be recycled by compressing the streams and introducing them into (and thereby combining them with) the first natural gas stream (105), prior to the first natural gas stream (107) being fed to and passed through the tube side of the first coil-wound heat exchanger section (108) as described above. For example, as illustrated in FIG. 1 the warmed second flash gas stream (150) may be sent to the low pressure suction of a recycle flash gas compressor train (140) and the warmed first flash gas stream (146) may be sent to an intermediate (higher pressure) suction of the compressor train (140). The compressor train (140) may for example comprise a multistage compressor or more than one compressor with ambient temperature intercoolers (for example using air or cooling water as the cooling medium), and with the warmed first flash gas stream (146) entering between compressor stages or compressors. The compressed flash gas stream exiting the compressor train (140) may then be cooled in an ambient temperature aftercooler (141), for example using air or cooling water as the cooling medium, forming a compressed ambient temperature flash gas stream that is then combined with the first natural gas stream (105).

Alternatively, in another embodiment (not shown) the warmed second flash gas stream (150) and warmed first flash gas stream (146) may then be recycled by compressing, cooling and, optionally, combining the two streams as described above, but by then not combining them with the first natural gas feed stream (105) but instead by cooling and liquefying the stream(s) in additional tube circuit(s) on the tube sides of the first and third coil wound heat exchanger sections (108, 116). The resulting separate liquefied flash gas stream(s) exiting the third coil wound heat exchanger (116) may then be combined, flashed and separated with the first liquefied natural gas stream (118) in, for example, the first flash drum (120). Such an alternative arrangement has the advantage that the discharge pressure of the recycle flash gas compressor train (140) may be optimized independently and may be lower than the pressure of first natural gas stream (105), resulting in a reduced power requirement and or reduced cost for the recycle flash gas compressor train (140), although it does require the provision and use of additional tube circuits in the first and third coil wound heat exchanger sections.

Refrigeration (cooling duty) for cooling and liquefying the first natural gas feed stream (107) to form the first liquefied natural gas feed stream (118) is provided by a gaseous refrigerant circulating in a closed-loop reverse Brayton cycle. The gaseous refrigerant is preferably predominantly or entirely methane, comprising preferably at least 50 mole % and more preferably at least 70 mole % methane, although other components such as for example nitrogen and/or ethane may also be present.

More specifically, a compressed feed stream of the gaseous refrigerant (174), that is preferably at a pressure of about 50 bara, is divided into first and second portions (176, 178), the first portion preferably constituting about 45% of the molar flow rate of the compressed feed stream of the gaseous refrigerant (174) and the second portion preferably constituting about 55% of the molar flow rate of the compressed feed stream of the gaseous refrigerant (174).

The first portion (176) of the compressed feed stream of gaseous refrigerant is further compressed, preferably to a pressure of about 90 bara, in a compressor forming the compression end of a first compander (compressor loaded expander) (154) before being cooled in an ambient temperature cooler (177), using for example ambient air or water as a cooling medium, to form a first gaseous stream of the refrigerant that is then expanded in a first turbo expander (112) (or other suitable form of isentropic expansion device) that forms the expansion end of the first compander (154), thereby forming a first expanded gaseous refrigerant stream (179) at a first pressure and a first temperature. Preferably the first expanded gaseous refrigerant stream (179) is at a pressure of about 30 bara. In the embodiment shown in FIG. 1 the first portion (176) is compressed using only the work from the first turbo-expander (112), but in other arrangements it may be further compressed before expansion using an external energy source such as an electric motor.

The second portion (178) of the compressed feed stream of gaseous refrigerant is further compressed in a compressor forming the compression end of a second compander (152) to form a further compressed stream (184), preferably at a pressure of about 80 bara, before being cooled in an ambient temperature cooler (186), using for example ambient air or water as a cooling medium, to form a further compressed and cooled stream (187) that is then divided to form a second gaseous stream of the refrigerant (188) and a third gaseous stream of the refrigerant (190). The second gaseous stream of the refrigerant (188) preferably constitutes about 20% of the molar flow rate of the further compressed and cooled stream (187), and the third gaseous stream of the refrigerant (190) preferably constitutes about 80% of the molar flow rate of the further compressed and cooled stream (187). In the embodiment shown in FIG. 1 the second portion (178) is compressed using only the work from a second turbo-expander (112) (further described below), but in other arrangements it may be further compressed using an external energy source such as an electric motor.

The second gaseous stream of the refrigerant (188) is fed to and passed through a tube circuit in the tube side of the first coil-wound heat exchanger section (108) (separate from the tube circuit in which the first natural gas stream (107) is cooled), in which the second gaseous stream of the refrigerant is cooled to form a precooled second gaseous refrigerant stream (192) that is withdrawn from the first coil-wound heat exchanger section, preferably at a temperature of about −25° C.

The third gaseous stream of the refrigerant (190) is fed to and passed through a tube circuit in the tube side of a second coil-wound heat exchanger section (110), in which the third 5 gaseous stream of the refrigerant is cooled to form a precooled third gaseous refrigerant stream (194) that is withdrawn from the second coil-wound heat exchanger section, preferably at a temperature of about −25° C.

The precooled second and third gaseous refrigerant streams (192, 194) are then combined forming a stream (196) that is then expanded in a second turbo expander (114) (or other suitable form of isentropic expansion device) that forms the expansion end of the second compander (152), thereby forming a second expanded gaseous refrigerant stream (182) at a second pressure and a second temperature, wherein the second pressure is lower than the first pressure and the second temperature is lower than the first temperature. Preferably the second expanded gaseous refrigerant stream (182) is at a pressure of about 17 bara.

The first expanded gaseous refrigerant stream (179) is fed to and passed through the shell side of the first coil-wound heat exchanger section (108) in which the first expanded gaseous refrigerant stream is warmed, via indirect heat exchange with the first natural gas stream (107) and the second gaseous stream of the refrigerant (188) passing through the tube side the first coil-wound heat exchanger section, forming a first warmed gaseous refrigerant stream (168) that is typically near ambient temperature.

The second expanded gaseous refrigerant stream (182) is fed to and passed through the shell side of the third coil-wound heat exchanger section (116), in which the second expanded gaseous refrigerant stream is warmed via indirect heat exchange with the first precooled natural gas stream (142) passing through the tube side the third coil-wound heat exchanger section. The resulting partially warmed second expanded gaseous refrigerant stream (198) exiting the shell side of the third coil-wound heat exchanger section is then fed to and passed through the shell side of the second coil-wound heat exchanger section (110), in which said stream is further warmed, via indirect heat exchange with the third gaseous stream of the refrigerant (190) passing through the tube side the second coil-wound heat exchanger section, forming a second warmed gaseous refrigerant stream (162) that is typically near ambient temperature.

Finally, the first warmed gaseous refrigerant stream and the second warmed gaseous refrigerant stream are compressed and combined to form the compressed feed stream of the gaseous refrigerant (174). For example, the second warmed gaseous refrigerant (162) may be compressed, preferably to a pressure of about 30 bara, in a lower pressure compressor or compression stage (164) and then cooled in an ambient temperature heat exchanger (166), using ambient air or water as a cooling medium, before being combined with the first warmed 5 gaseous refrigerant stream (168) to form a combined stream that is compressed in a higher pressure compressor or compression stage (170) and then cooled in an ambient temperature heat exchanger (172), using ambient air or water as a cooling medium, to form the compressed feed stream of the gaseous refrigerant (174).

Accordingly, in the embodiment depicted in FIG. 1, the first and second coil-wound heat exchanger sections (108 and 110) are used for precooling purposes (i.e. for precooling the first natural gas stream (107) and the second and third gaseous stream of the refrigerant (188) and (190)) and the third coil-wound heat exchanger (116) is used for liquefaction purposes (i.e. for liquefying the first precooled natural gas stream (142)), with said heat exchanger sections being configured and arranged such that the shell side of the first coil-wound heat exchanger section(108) is separated from the shell side of the second and third coil-wound heat exchanger sections (110 and 116) such that the shell side of the first coil-wound heat exchanger section can operate at a different pressure than the shell side of the second and third coil-wound heat exchanger sections, the shell side of the first heat exchanger section receiving and using the first expanded gaseous refrigerant stream (179) that is at a higher pressure (the first pressure) than the pressure (the second pressure) of the second expanded gaseous refrigerant stream (182) that is received and used by the shell side of the third heat exchanger section and second heat exchanger section.

In the embodiment depicted in FIG. 1, the first coil-wound heat exchanger section (108), second coil-wound heat exchanger section (110) and third coil-wound heat exchanger section (116) each consist of a single tube bundle enclosed in its own shell casing, but other arrangements are also possible. One or more or all of the first, second and third coil-wound heat exchanger sections could comprise more than one tube bundle. The second heat exchanger section and third heat exchanger section could share and be contained within the same shell casing such that refrigerant flowing through (and being warmed in) the shell side of the third heat exchanger section continues onwards to flow through (and be further warmed in) the shell side of the second heat exchanger section. Alternatively, the first heat exchanger section and third heat exchanger section could share and be contained within the same shell casing, but with said shell casing further containing an internal bulk head separating the shell side of the third heat exchanger section from the shell side of the first heat exchanger section preventing refrigerant in the shell side of the third section from flowing into the shell side of the first section, and vice versa, thereby allowing the shell side of the first coil-wound heat exchanger section to operate at a different pressure than the shell side of third (and second) coil-wound heat exchanger sections.

In the embodiment depicted in FIG. 1, the first turbo-expander (112) and second turbo-expander (114) are, as described above, the expansion ends of a first compander (154) and second compander (177), respectively. However, in other arrangements companders need not be used, and instead separately driven compressors could be used for compressing the first portion (176) and second portion (178) of the compressed feed stream of gaseous refrigerant, and the work produced by the first and second turbo-expanders (or other suitable form of isentropic expansion device) may be put to other uses, such as for example driving an electric generator.

The method and system of FIG. 1 provide several advantages. Coil-wound heat exchangers are a robust design of heat exchanger, and can improve the scalability of a process (since one CWHE can process as much fluid as four or more heat exchangers of the plate and fin type), but they are limited to the use of a single shell-side refrigerant. Using two parallel coil-wound heat exchanger sections for precooling purposes, in the form of the first and second coil-wound heat exchanger sections (108, 110), with the shell side of the first coil-wound heat exchanger section (108) being kept separate from the shell side of the second heat exchanger section (110) and the shell side of the heat exchanger section used for liquefaction purposes, namely the third heat exchanger section (116), allows the use of a shell side refrigerant stream (179) in the first heat exchanger section that is at a different pressure than pressure of the refrigerant stream (182) used in the second and third heat exchanger sections, thereby allowing a closer match in the cooling curves in the liquefaction heat exchanger (the third heat exchanger section). This in turn allows power to be shifted from the recycle flash gas compressor train (140) to the compressors (164, 170) used for compressing the gaseous refrigerant, and improves the overall specific power of the process, while still providing the aforementioned benefits of using heat exchangers of the coil-wound type. Reducing the power required by the recycle flash gas recycle compressor train also opens the possibility for use of an electric motor driver for this compressor train, while improving the specific power of the process reduces utility consumption and greenhouse gas emissions for a fixed production or increases production for a fixed investment in compressor driver power.

In addition to the above, withdrawing the first natural gas side stream (134) and second natural gas side stream (136) from intermediate locations of, respectively, the fourth heat exchanger section (126) and fifth heat exchanger section (128), and introducing these 5 streams into the first precooled natural gas stream (142) prior to said stream being fed into the third coil-wound heat exchanger section (116), shifts even more power from the recycle flash gas compressor train (140) to the compressors (164, 170) used for compressing the gaseous refrigerant, further improves the process efficiency through closer alignment of the cooling curves in each exchanger, and thus further improves specific power of the process. Withdrawing said natural gas side streams also avoids exposing the fourth and fifth exchanger sections to large temperature differences between the tube side and shell side, and therefore reduces the potential for damaging thermal stress to the equipment.

Figure 2:
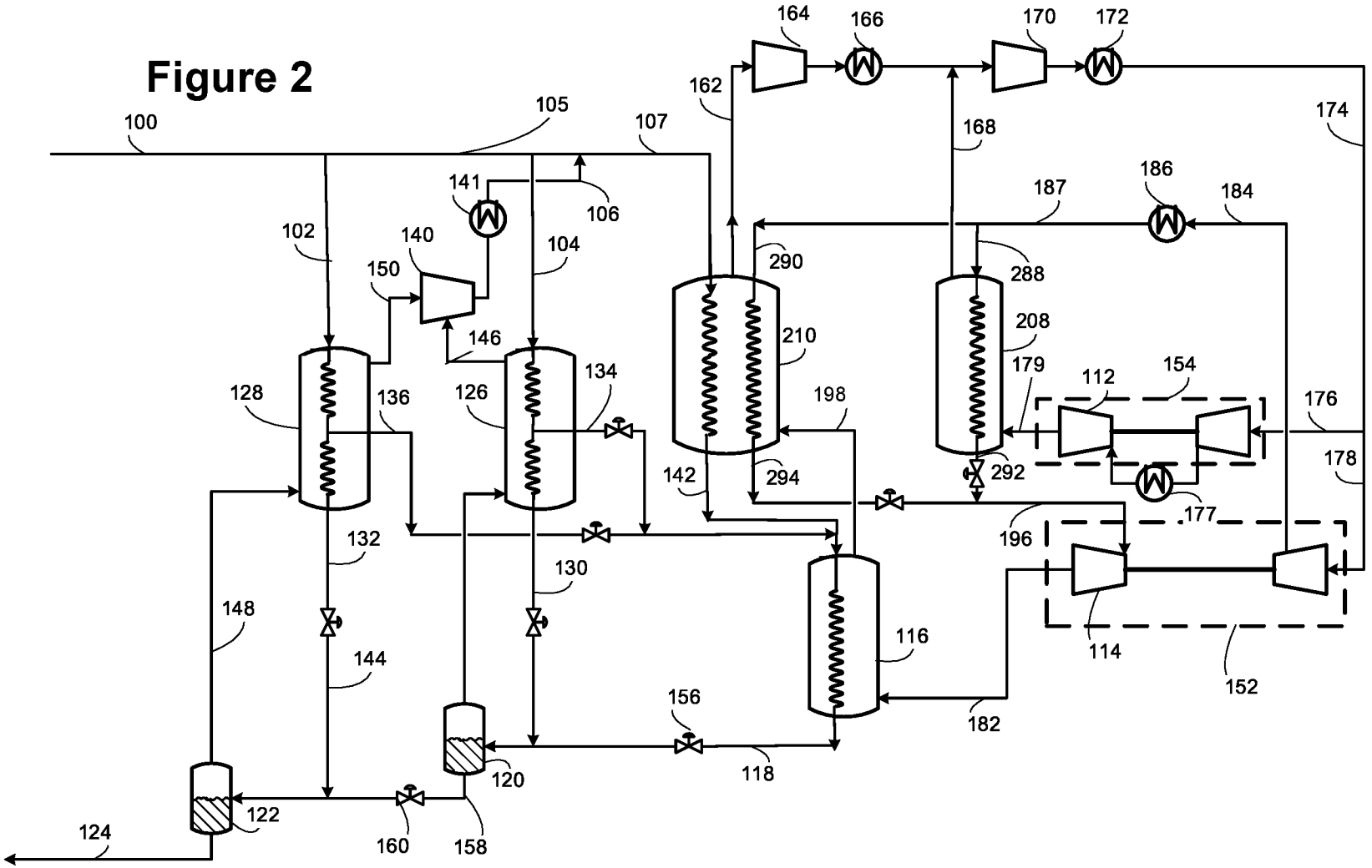
FIG. 2 a schematic flow diagram depicting a method and system for cooling and liquefying natural gas according to a second embodiment of the present invention.

Referring now to FIG. 2, a method and system for cooling and liquefying natural gas in accordance with a second embodiment of the present invention is shown.

The embodiment depicted in FIG. 2 differs from that depicted in FIG. 1 in the arrangement of the tube side circuits within the first and second coil-wound heat exchanger sections (208 and 210). In the embodiment depicted in FIG. 2, first natural gas stream (107) is not fed to the first coil wound heat exchanger (208), but is instead fed to and passed through a tube circuit in the tube side of the second coil-wound heat exchanger section (210) where it is cooled, preferably to a temperature of between 10 and −50° C. and more preferably to a temperature of between 0 and −30° C., to the first precooled natural gas stream (142). To properly balance the cooling duty in the first and second coil wound heat exchangers (208 and 210), the division of further compressed and cooled stream of refrigerant (187), between second gaseous stream of the refrigerant (288) sent to a tube circuit in the tube side the first coil wound heat exchanger section (208) and the third gaseous stream of the refrigerant (290) sent to a tube circuit in the tube side of the second coil wound heat exchanger (210), is also different from that in the embodiment depicted in FIG. 1. For the embodiment depicted in FIG. 2, the second gaseous stream of the refrigerant (288) preferably constitutes about 60% of the molar flow rate of the further compressed and cooled stream (187), while the third gaseous stream of the refrigerant (290) preferably constitutes about 40% of the molar flow rate of the further compressed and cooled stream (187).

In yet another embodiment of the invention (not shown), the first natural gas stream (107) could itself be divided into two streams, with one of said streams being fed to and passed through a tube circuit in the tube side of the first coil-wound heat exchanger section and the other of said streams being fed to and passed through a tube circuit in the tube side of the second coil-wound heat exchanger section, such that both the first coil-wound heat exchanger section and the second coil wound heat exchanger section receive and cool part of the further compressed and cooled gaseous refrigerant stream (187) and part of the natural gas feed stream (100). However, this embodiment incurs additional costs due to the requirement for two tube circuits in both the first and second heat exchanger sections, with the associated additional piping to and from said circuits, and the additional complexity of then controlling the division of natural and refrigerant between both heat exchanger sections.

Example 1

In this example, a method and system for cooling and thereby liquefying natural gas as depicted in FIG. 1 was simulated, using Aspen simulation software, version 10, from Aspen Technology, Inc. Table 1 below provides stream data from the simulation.

TABLE 1

| Stream | | 100 | 105 | 106 | 107 | 102 | 104 | 150 | 146 | 136 | 134 | 132 |
|---|---|---|---|---|---|---|---|---|---|---|---|---|
| Temperature | ° C. | 40 | 40 | 40 | 40 | 40 | 40 | 34 | 34 | −15 | −17 | −145 |
| Pressure | bara | 86.0 | 86.0 | 86.0 | 86.0 | 86.0 | 86.0 | 2.4 | 9.5 | 85.3 | 85.0 | 84.6 |
| Vapor Fraction | | 1.00 | 1.00 | 1.00 | 1.00 | 1.00 | 1.00 | 1.00 | 1.00 | 1.00 | 1.00 | 0.00 |
| Mole Flows | kmol/hr | 24680 | 18554 | 12160 | 30714 | 3143 | 5735 | 5051 | 9135 | 1021 | 1889 | 2123 |

| Stream | | 130 | 148 | 144 | 142 | 118 | 158 | 124 | 162 | 168 | 174 | 176 |
|---|---|---|---|---|---|---|---|---|---|---|---|---|
| Temperature | ° C. | −125 | −147 | −127 | −28 | −103 | −127 | −147 | 35 | 35 | 40 | 40 |
| Pressure | bara | 82.6 | 3.0 | 10.4 | 83.9 | 81.0 | 10.4 | 3.0 | 16.6 | 29.2 | 51.4 | 51.4 |
| Vapor Fraction | | 0.00 | 1.00 | 1.00 | 1.00 | 0.00 | 0.00 | 0.00 | 1.00 | 1.00 | 1.00 | 1.00 |
| Mole Flows | kmol/hr | 3846 | 5051 | 21296 | 30714 | 33624 | 28334 | 25406 | 79157 | 60009 | 139166 | 60009 |

TABLE 1-continued

| Stream | | 178 | 196 | 182 | 190 | 179 | 184 | 187 | 188 | 190 | 192 | 194 |
|---|---|---|---|---|---|---|---|---|---|---|---|---|
| Temperature | ° C. | 40 | −27 | −106 | −33 | −33 | 85 | 40 | 40 | 40 | −27 | −27 |
| Pressure | bara | 51.4 | 79.9 | 18.0 | 17.4 | 29.8 | 83.3 | 82.7 | 82.7 | 82.7 | 79.9 | 79.9 |
| Vapor Fraction | | 1.00 | 1.00 | 1.00 | 1.00 | 1.00 | 1.00 | 1.00 | 1.00 | 1.00 | 1.00 | 1.00 |
| Mole Flows | kmol/hr | 79157 | 79157 | 79157 | 79157 | 60009 | 79157 | 79157 | 17652 | 61505 | 17652 | 61505 |

It will be appreciated that the invention is not restricted to the details described above with reference to the preferred embodiments but that numerous modifications and variations can be made without departing from the spirit or scope of the invention as defined in the following claims.

The invention claimed is:

1. A method of liquefying natural gas via indirect heat exchange with a refrigerant, the method using first, second and third coil-wound heat exchanger sections each having a tube side and a shell side, the shell side of the first coil-wound heat exchanger section being separated from and at a different pressure from the shell side of the second and third coil-wound heat exchanger sections, the method comprising the steps of:

(a) passing a first natural gas stream through and cooling the first natural gas stream in the tube side of the first or second coil-wound heat exchanger section to form a first precooled natural gas stream;

(b) passing the first precooled natural gas stream through and further cooling and liquefying the first precooled natural gas stream in the tube side of the third coil-wound heat exchanger section to form a first liquefied natural gas stream;

(c) combining, flashing and separating the first liquefied natural gas stream and a second liquefied natural gas stream to form a liquefied natural gas (LNG) product and one or more flash gas streams, said one or more flash gas streams comprising a first flash gas stream;

(d) expanding a first gaseous stream of the refrigerant to form a first expanded gaseous refrigerant stream at a first pressure and a first temperature;

(e) passing the first expanded gaseous refrigerant stream through and warming the first expanded gaseous refrigerant stream in the shell side of the first coil-wound heat exchanger section to form a first warmed gaseous refrigerant stream;

(f) passing a second gaseous stream of the refrigerant through and cooling the second gaseous stream of the refrigerant in the tube side of the first coil-wound heat exchanger section to form a precooled second gaseous refrigerant stream;

(g) passing a third gaseous stream of the refrigerant through and cooling the third gaseous stream of the refrigerant in the tube side of the second coil-wound heat exchanger section to form a precooled third gaseous refrigerant stream;

(h) combining and expanding the precooled second and third gaseous refrigerant streams to form a second expanded gaseous refrigerant stream at a second pressure and a second temperature, wherein the second pressure is lower than the first pressure and the second temperature is lower than the first temperature;

(i) passing the second expanded gaseous refrigerant stream through and warming the second expanded gaseous refrigerant stream in the shell-side of the third coil-wound heat exchanger section and then the shell-side of the second heat exchanger section to form a second warmed gaseous refrigerant stream;

(i) dividing a natural gas feed stream to form the first natural gas stream and a second natural gas stream;

(k) warming the first flash gas stream in a fourth heat exchanger section;

(l) passing the second natural gas stream through and cooling and liquefying the second natural gas stream in the fourth heat exchanger section, via indirect heat exchange with the first flash gas stream, to form the second liquefied natural gas stream;

(m) withdrawing a precooled portion of the second natural gas stream as a first natural gas side stream from an intermediate location of the fourth heat exchanger section; and (n) introducing the first natural gas side stream into the first precooled natural gas stream before carrying out step (b).

2. A method as claimed in claim 1, wherein the method further comprises:

(o) compressing and combining the first warmed gaseous refrigerant stream and the second warmed gaseous refrigerant stream to form a compressed gaseous refrigerant stream; and (p) dividing the compressed gaseous refrigerant stream to form the first gaseous stream of the refrigerant, second gaseous stream of the refrigerant, and third gaseous stream of the refrigerant.

3. A method as claimed in claim 1, wherein the first natural gas side stream constitutes less than 50% of the molar flow rate of the second natural gas stream entering the fourth heat exchanger section.

4. A method as claimed in claim 1, wherein in step (c) the first liquefied natural gas stream and the second liquefied natural gas stream are combined, flashed and separated to form the LNG product and the one or more flash gas streams by combining, flashing and separating the first liquefied natural gas stream and the second liquefied natural gas stream to form a fourth liquefied natural gas stream and the first flash gas stream, and then combining, flashing and separating the fourth liquefied natural gas stream and a third liquefied natural gas stream to form the LNG product and a second flash gas stream;

wherein step (i) comprises dividing the natural gas feed stream to form the first natural gas stream, the second natural gas stream and a third natural gas stream; and wherein the method further comprises;

(q) warming the second flash gas stream in a fifth heat exchanger section; and (r) passing the third natural gas stream through and cooling and liquefying the third natural gas stream in the fifth heat exchanger section to form the third liquefied natural gas stream.

5. A method as claimed in claim 4, wherein the method further comprises:

(s) withdrawing a precooled portion of the third natural gas stream as a second natural gas side stream from an intermediate location of the fifth heat exchanger section;

(t) introducing the second natural gas side stream into the first precooled natural gas stream before carrying out step (b).

6. A method as claimed in claim 5, wherein the second natural gas side stream constitutes less than 50% of the molar flow rate of the third natural gas stream entering the fifth heat exchanger section.

7. A method as claimed in claim 1, wherein the first natural gas stream constitutes more than 50% of the molar flow rate of the natural gas feed stream.

8. A method as claimed in claim 1, wherein the refrigerant is a refrigerant comprising more than 50 mole % methane.

9. A method as claimed in claim 1, wherein the refrigerant circulates in a closed-loop circuit.

10. A method as claimed in claim 1, wherein the first natural gas stream is at a pressure of at least 60 bara.

11. A method as claimed in claim 1, wherein the first precooled natural gas stream is at a temperature of between 10° C. and −50° C.

12. A method as claimed in claim 1, wherein the first liquefied natural gas stream is withdrawn from the third coil-wound heat exchanger section at a temperature of between −90° C. and −120° C.

13. A system for liquefying natural gas via indirect heat exchange with a refrigerant, wherein the system comprises:

a first coil-wound heat exchanger section having a tube side and a shell side;

a second coil-wound heat exchanger section having a tube side and a shell side;

a third coil-wound heat exchanger section having a tube side and a shell side;

a conduit configured and arranged to introduce a first natural gas stream into the tube side of the first or second coil-wound heat exchanger section, said tube side of the first or second coil-wound heat exchanger section being configured to cool the first natural gas stream to form a first precooled natural gas stream;

a conduit configured and arranged to withdraw the first precooled natural gas stream from said tube side of the first or second coil-wound heat exchanger section and introduce the first precooled natural gas stream into the tube side of the third coil-wound heat exchanger section, the tube side of the third coil-wound heat exchanger section being configured to further cool and liquefy the first precooled natural gas stream to form a first liquefied natural gas stream;

one or more expansion and separation devices configured and arranged to receive, flash and separate the first liquefied natural gas stream and a second liquefied natural gas stream to form a liquefied natural gas (LNG) product and one or more flash gas streams, said one or more flash gas streams comprising a first flash gas stream;

an expansion device configured and arranged to receive and expand a first gaseous stream of the refrigerant to form a first expanded gaseous refrigerant stream;

a conduit configured and arranged to introduce the first expanded gaseous refrigerant stream into the shell side of the first coil-wound heat exchanger section, the shell side of the first coil-wound heat exchanger section being configured to warm the first expanded gaseous refrigerant stream to form a first warmed gaseous refrigerant stream;

a conduit configured and arranged to introduce a second gaseous stream of the refrigerant into the tube side of the first coil-wound heat exchanger section, the tube side of the first coil-wound heat exchanger section being configured to cool the second gaseous stream of the refrigerant to form a precooled second gaseous refrigerant stream;

a conduit configured and arranged to introduce a third gaseous stream of the refrigerant into the tube side of the second coil-wound heat exchanger section, the tube side of the second coil-wound heat exchanger section being configured to cool the third gaseous stream of the refrigerant to form a precooled third gaseous refrigerant stream;

one or more conduits and expansion devices configured and arranged to receive, combine and expand the precooled second and third gaseous refrigerant streams to form a second expanded gaseous refrigerant stream;

a conduit configured and arranged to introduce the second expanded gaseous refrigerant stream into the shell-side of the third coil-wound heat exchanger section, the shell-side of the third coil-wound heat exchanger being configured to warm the second expanded gaseous refrigerant stream and the shell-side of the second coil-wound heat exchanger being configured to then receive and further warm the second expanded gaseous refrigerant stream to form a second warmed gaseous refrigerant stream;

a set of conduits configured and arranged to divide a natural gas feed stream to form the first natural gas stream and a second natural gas stream;

a fourth heat exchanger section configured and arranged to receive and warm the first flash gas stream, and to receive and cool and liquefy the second natural gas stream via indirect heat exchange with the first flash gas stream to form the second liquefied natural gas stream; and a conduit configured and arranged to withdraw a precooled portion of the second natural gas stream as a first natural gas side stream from an intermediate location of the fourth heat exchanger section and to introduce the first natural gas side stream into the first precooled natural gas stream prior to introduction of the first precooled natural gas stream into the tube side of the third coil-wound heat exchanger section;

wherein the shell side of the first coil-wound heat exchanger section is separated from the shell side of the second and third coil-wound heat exchanger sections such that the shell side of the first coil-wound heat exchanger section can be at a different pressure to the shell side of the second and third coil-wound heat exchanger sections.

14. A system as claimed in claim 13, wherein the system further comprises:

one or more conduits and compression devices configured and arranged to compress and combine the first warmed gaseous refrigerant stream and the second warmed gaseous refrigerant stream to form a compressed gaseous refrigerant stream; and a set of conduits configured and arranged to divide the compressed gaseous refrigerant stream to form the first compressed gaseous stream of the refrigerant, second compressed gaseous stream of the refrigerant, and third compressed gaseous stream of the refrigerant.

15. A system as claimed in claim 13, wherein the one or more expansion and separation devices configured and arranged to receive, flash and separate the first liquefied natural gas stream and the second liquefied natural gas stream to form the LNG product and the one or more flash gas streams comprise a first set of expansion and separation devices configured and arranged to receive, flash and separate the first liquefied natural gas stream and the second liquefied natural gas stream to form a fourth liquefied natural gas stream and the first flash gas stream, and a second set of expansion and separation devices configured and arranged to receive, flash and separate the fourth liquefied natural gas stream and a third liquefied natural gas stream to form the LNG product and a second flash gas stream;

wherein the set of conduits configured and arranged to divide a natural gas feed stream are configured and arranged to divide the natural gas feed stream to form the first natural gas stream, the second natural gas stream and a third natural gas stream; and wherein the system further comprises fifth heat exchanger section configured and arranged to receive and warm the second flash gas stream, and to receive cool and liquefy the third natural gas stream via indirect heat exchange with the second flash gas stream to form the third liquefied natural gas stream.

16. A system as claimed in claim 15, wherein the method further comprises a conduit configured and arranged to withdraw a precooled portion of the third natural gas stream as a second natural gas side stream from an intermediate location of the fifth heat exchanger section and to introduce the second natural gas side stream into the first precooled natural gas stream prior to introduction of the first precooled natural gas stream into the tube side of the third coil-wound heat exchanger section.

* * * * *